US007059923B2

(12) United States Patent
Jürgens et al.

(10) Patent No.: US 7,059,923 B2
(45) Date of Patent: Jun. 13, 2006

(54) CYCLOIDAL PROPELLER

(75) Inventors: Dirk Jürgens, Heldenhelm (DE); Michael Palm, Heldenhelm (DE)

(73) Assignee: Voith Turbo Marine GmbH & Co., KG, Heindenheim (DE)

( * ) Notice: Subject to any disclaimer, the term of this patent is extended or adjusted under 35 U.S.C. 154(b) by 0 days.

(21) Appl. No.: 11/114,467

(22) Filed: Apr. 26, 2005

(65) Prior Publication Data

US 2005/0272325 A1 Dec. 8, 2005

(30) Foreign Application Priority Data

Apr. 26, 2004 (DE) ..... 10 2004 020 552

(51) Int. Cl.
*B63H 1/04* (2006.01)

(52) U.S. Cl. ..... 440/93

(58) Field of Classification Search ..... 440/66, 440/68–70, 93
See application file for complete search history.

(56) References Cited

U.S. PATENT DOCUMENTS 2,184,865 A * 12/1939 Mueller et al. ..... 440/66

* cited by examiner

*Primary Examiner*—Ed Swinehart
(74) *Attorney, Agent, or Firm*—Ohlandt, Greeley, Ruggiero & Perle, L.L.P.

(57) ABSTRACT

A cycloidal propeller for a boat is provided that has a protective guard with one or more slots therethrough, which run at least approximately perpendicular to the direction of travel of the boat.

16 Claims, 2 Drawing Sheets

Fig.1
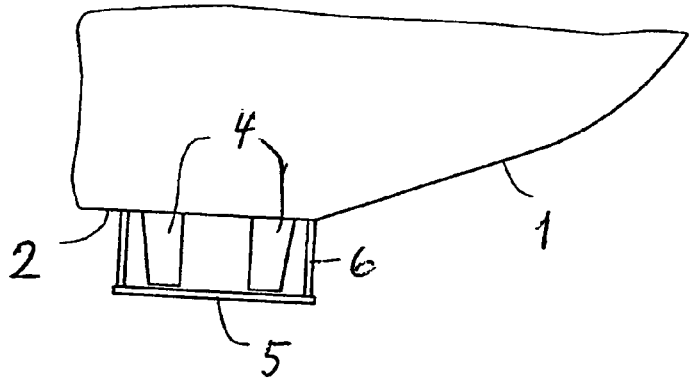
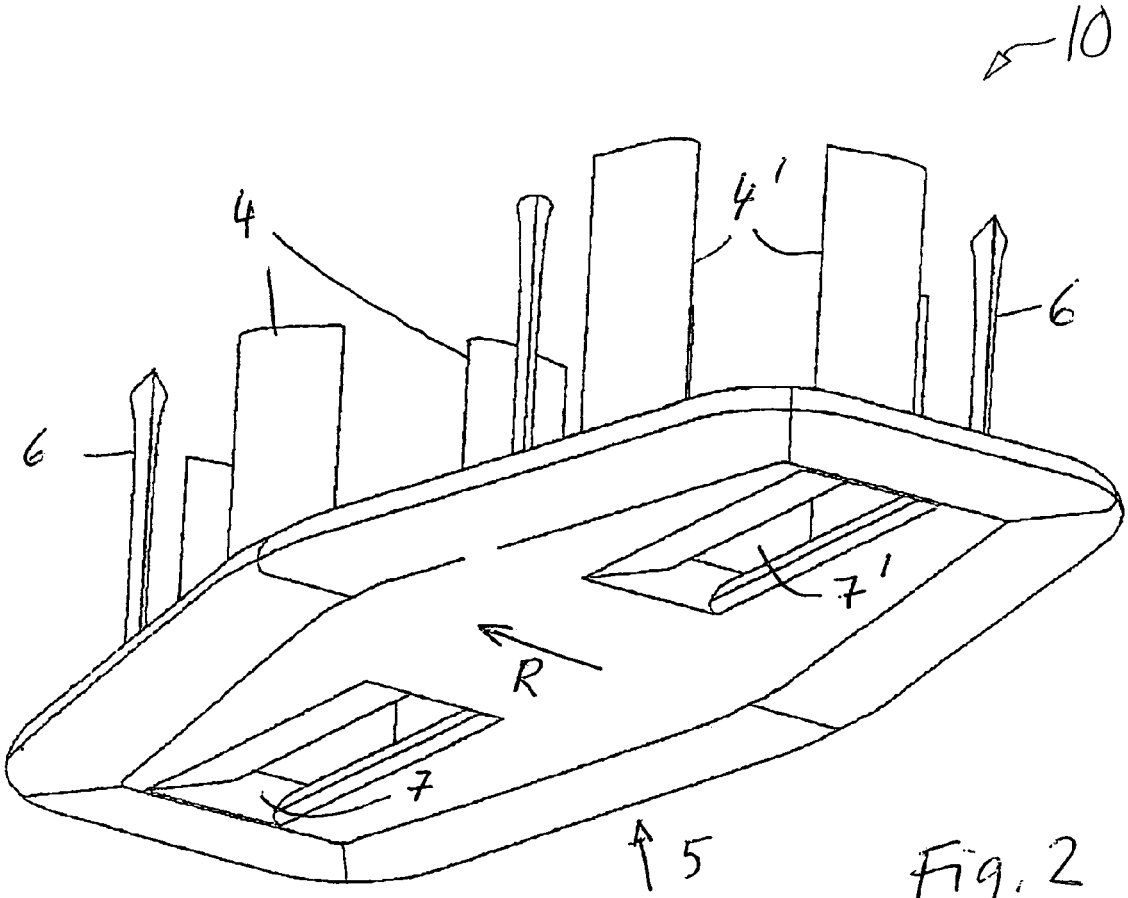
Fig. 2

CYCLOIDAL PROPELLER

RELATED APPLICATIONS

This application claims priority in German Application No. DE 10 2004 020 522.1, filed on Apr. 26, 2004, the disclosure of which is incorporated herein by reference.

BACKGROUND OF THE INVENTION

1. Field of the Invention

The invention concerns a cycloidal propeller, also called a VOITH-SCHNEIDER® propeller (VSP®), comprising a rotor, which has a number of blades.

2. Description of the Related Art

During operation, the blades of a cycloidal propeller carry out an oscillating motion about a pivoting axis. The pivoting axes of the blades run parallel to the axis of rotation of the rotor. A protective plate or guard, which runs at least approximately perpendicular to the axis of rotation of the rotor and thus to the pivoting axes of the blades is provided at the free end of the blades.

The protective guard is fastened by means of struts to the bottom of the boat. It serves to protect the propeller from damage, for example, if the latter contacts the ground. In addition, it produces an additional thrust in the case of high axial loads. Finally, it serves as a bracket in the docking of the boat.

VOITH-SCHNEIDER® propellers are utilized for tugboats, supply ships or ferry boats. They are extremely maneuverable and are excellently suitable for towing very large boats.

SUMMARY OF THE INVENTION

The object of the invention is to create a cycloidal propeller of the named type in such a way that the efficiency factor or degree of efficiency and the smoothness of running are improved.

The inventors have recognized that for this purpose, the named protective guard need only be provided with a through-slot, which extends crosswise to the direction of travel. The efficiency factor can be increased by several percent by this extremely simple and inexpensive measure. Increases of up to 5 percent have been achieved. The oscillations are also reduced, whereupon the smoothness of running is considerably increased. In addition, the mechanical stresses on the VSP are reduced.

In one aspect, a protective guard for a cycloidal propeller of a boat having a direction of travel is provided. The cycloidal propeller has a rotor with a plurality of blades, and each of the plurality of blades is movable by the rotor in an oscillating motion around a pivoting axis. The pivoting axes of each of the plurality of blades is parallel to an axis of rotation of the rotor. The protective guard has a body substantially perpendicular to the axis of rotation of the rotor and to the pivoting axes of each of the plurality of blades. The body of the protective guard is in proximity to a free end of each of the plurality of blades. The body has at least one slot therethrough that is substantially perpendicular to the direction of travel of the boat.

In another aspect, a cycloidal propeller for a boat having a direction of travel is provided. The cycloidal propeller has a rotor and a protective guard. The rotor has a plurality of blades, with each blade being moved by the rotor in an oscillating motion around a pivoting axis during operation. The pivoting axes of each of the plurality of blades is parallel to an axis of rotation of the rotor. The protective guard is substantially perpendicular to the axis of rotation of the rotor and to the pivoting axes of each of the plurality of blades. The protective guard is also in proximity to a free end of each of the plurality of blades. The protective guard has at least one slot therethrough that is substantially perpendicular to the direction of travel of the boat.

In yet another aspect, a method of protecting a cycloidal propeller is provided comprising providing a protective guard substantially perpendicular to an axis of rotation of a rotor of the cycloidal propeller and to a pivoting axes of each blade of the cycloidal propeller and in proximity to a free end of each blade; and directing flow through at least one slot in the protective guard. The slot has a length that is substantially perpendicular to the direction of travel of the boat and substantially equal to a length of the protective guard, measured crosswise to the direction of travel of the boat.

The slot can be defined at least in part by a rounded edge. A surface region of the protective guard against which current flows can be profiled as a blade support. The slot can have a length substantially equal to a length of the protective guard, measured crosswise to the direction of travel of the boat. The slot may be a plurality of slots positioned next to one another perpendicular to the direction of travel of the boat. The slot can be a plurality of slots positioned one behind the other in the direction of travel of the boat. The cycloidal propeller can further comprise a plurality of struts connecting the protective guard to the boat.

BRIEF DESCRIPTION OF THE DRAWINGS

The invention is explained in more detail based on the drawing. Therein, the following are shown individually:

FIG. 1 illustrates a portion of a boat hull with a VOITH-SCHNEIDER® propeller in vertical section;

FIG. 2 illustrates a schematic perspective representation of the blades of two VOITHSCHNEIDER® propellers, which are disposed next to one another, with a common protective guard according to an exemplary embodiment of the present invention.

DESCRIPTION OF THE INVENTION

Figure 3:
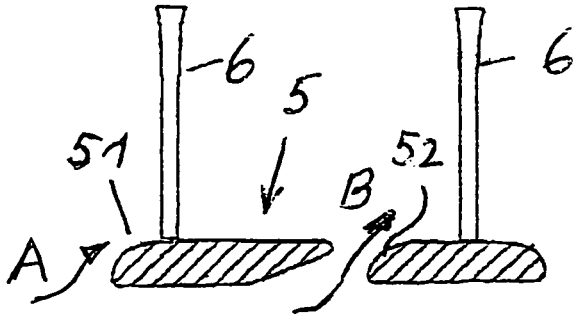
FIG. 3 illustrates the protective guard of FIG. 2 in cross-section.

The bow 1 of a tractor tug can be recognized in FIG. 1. A VSP® is disposed on the bottom 2 of the tractor tug. The VSP® could also be disposed at the stern of the tractor tug. It is also conceivable to dispose VSP® s both at the bow and also at the stern, optionally in combination with other boat propulsion devices and/or in other arrangements or configurations with respect to the boat.

The VSP has a number of blades 4. The blades 4 are disposed on a wheel body, which is not shown here. They can be turned around or about vertical pivoting axes and oscillate back and forth around these pivoting axes during operation.

A protective guard 5 is under blades 4. The protective guard 5 has a body that runs substantially horizontally with respect to the boat. The protective guard 5 is fixed to the bottom 2 of the tractor tug by means of a number of struts 6.

The direction of travel R of the tractor tug is indicated in FIG. 2. A pair of VSP®s are shown and generally referred to by reference numeral 10. The blades 4 and 4' of the two VSP®s 10 are shown. The two VSP®s 10 are disposed or positioned next to one another, on both sides of the longitudinal axis of the tractor tug, which is not shown here.

The protective guard 5 has a body with two slots 7, 7'. They lie flush with one another and run perpendicular to the direction of travel R. The two slots 7, 7' extend through the protective guard 5 and preferably are defined in part by at least one rounded or chamfered edge. Alternatively, the slots 7,7' can be positioned one behind the other in the direction of travel R. Also, the number of slots can be varied including a single slot, as well as two or more slots.

The profiling of the protective guard 5 can be recognized in FIG. 3, and is shown in an end region of the protective guard 5. As can be seen, the surface region 51 of the protective guard 5 against which the current flows during travel is profiled like a type of blade support, but at the same time the surface region 52, which the current flows around, can also be seen.

Arrow A illustrates the current, which surrounds the surface region 51 of the protective guard 5 against which the current flows, and arrow B shows the current which enters the slot 7' from below and surrounds the respective surface region 52. Slots 7 and 7' have a rectangular shape. As shown clearly in the cross-sectional view of FIG. 3, the lower surface of the protective guard 5 is tapered towards slot 7 to define the leading edge of the slot, while the upper surface of the protective guard is tapered towards the slot to define the trailing edge of the slot.

What is claimed is:

1. A protective guard for a cycloidal propeller of a boat having a direction of travel, the cycloidal propeller having a rotor with a plurality of blades, each of the plurality of blades being moved by the rotor in an oscillating motion around a pivoting axis during operation, the pivoting axes of each of the plurality of blades being parallel to an axis of rotation of the rotor, the protective guard comprising:

a body being substantially perpendicular to the axis of rotation of the rotor and to the pivoting axes of each of the plurality of blades and being in proximity to a free end of each of the plurality of blades, wherein said body has at least one slot therethrough that is substantially perpendicular to the direction of travel of the boat, wherein said at least one slot has edges that are parallel and wherein at least one of said edges is rounded.

2. The protective guard of claim 1, wherein two of said edges are rounded.

3. The protective guard of claim 1, wherein said at least one slot has a leading edge that is tapered along a lower surface of the protective guard.

4. The protective guard of claim 1, wherein said at least one slot is a plurality of slots positioned next to one another perpendicular to the direction of travel of the boat.

5. The protective guard of claim 1, wherein said at least one slot has a trailing edge that is tapered along an upper surface of the protective guard.

6. The protective guard of claim 1, wherein said at least one slot is rectangular.

7. A cycloidal propeller for a boat having a direction of travel comprising:

a rotor having a plurality of blades, each blade being moved by said rotor in an oscillating motion around a pivoting axis during operation, said pivoting axes of each of said plurality of blades being parallel to an axis of rotation of said rotor; and a protective guard being substantially perpendicular to said axis of rotation of said rotor and to said pivoting axes of each of said plurality of blades and being in proximity to a free end of each of said plurality of blades; wherein said protective guard has at least one slot therethrough that is substantially perpendicular to the direction of travel of the boat wherein said at least one slot has edges that are parallel and wherein at least one of said edges is rounded.

8. The cycloidal propeller of claim 7, wherein said protective guard has a lower surface that is tapered to define a leading edge of said at least one slot.

9. The cycloidal propeller of claim 7, wherein a surface region of said protective guard against which current flows is profiled as a blade support.

10. The cycloidal propeller of claim 7, wherein said at least one slot is rectangular.

11. The cycloidal propeller of claim 7, wherein said at least one slot is a plurality of slots positioned next to one another perpendicular to the direction of travel of the boat.

12. The cycloidal propeller of claim 7, wherein said protective guard has an upper surface that is tapered to define a trailing edge of said at least one slot.

13. The cycloidal propeller of claim 7, further comprising a plurality of struts connecting said protective guard to the boat.

14. A method of protecting a cycloidal propeller of a boat having a direction of travel comprising:

providing a protective guard substantially perpendicular to an axis of rotation of a rotor of the cycloidal propeller and to a pivoting axes of each blade of the cycloidal propeller and in proximity to a free end of each blade; and directing flow through at least one slot in said protective guard utilizing a lower surface of the protective guard with a taper to guide said flow along a leading edge of said at least one slot and utilizing an upper surface of the protective guard with a taper to guide said flow along a trailing edge of said at least one slot.

15. The method of claim 14, further comprising connecting said protective guard in proximity to said free end of each blade via one or more struts.

16. The method of claim 14, further comprising directing said flow through parallel edges of said at least one slot.

* * * * *